US005107640A

United States Patent [19]

Gefroh et al.

[11] Patent Number: 5,107,640

[45] Date of Patent: * Apr. 28, 1992

[54] MODULAR ACCESSIBLE AREAWAY SYSTEM

[75] Inventors: James A. Gefroh; Fredric J. Hattman, both of Fort Collins, Colo.

[73] Assignee: RM Base Company, Fort Collins, Colo.

[ * ] Notice: The portion of the term of this patent subsequent to Oct. 13, 2006 has been disclaimed.

[21] Appl. No.: 604,754

[22] Filed: Oct. 26, 1990

[51] Int. Cl.[5] ..... E04F 17/06

[52] U.S. Cl. ..... 52/107

[58] Field of Search ..... 52/107, 19, 169.6, 183, 52/184, 182, 191, 188, 189; 47/83; 405/284, 285

[56] References Cited

U.S. PATENT DOCUMENTS

| | | | |
|---|---|---|---|
| 300,654 | 6/1884 | Smith . | |
| 1,257,221 | 2/1918 | Grossman | 52/188 |
| 1,695,810 | 12/1928 | Magill . | |
| 1,803,091 | 4/1931 | Bemis . | |
| 1,840,397 | 1/1932 | Keyes . | |
| 2,162,628 | 6/1939 | Martin . | |
| 2,237,564 | 4/1941 | Keyes . | |
| 2,308,131 | 1/1943 | Wellnitz . | |
| 2,316,712 | 4/1943 | Prince et al. . | |
| 2,453,609 | 11/1948 | Whitehouse . | |
| 2,695,689 | 11/1954 | Peterson . | |
| 2,761,180 | 9/1956 | Krelwitz . | |
| 3,004,634 | 10/1961 | Evans et al. . | |
| 3,470,664 | 10/1969 | Whitehead | 52/183 |
| 3,608,252 | 9/1971 | Bisson . | |
| 3,844,076 | 10/1974 | Schlick . | |
| 3,848,378 | 11/1974 | Witte . | |
| 3,999,334 | 12/1976 | Webb . | |
| 4,226,062 | 10/1980 | Doane . | |
| 4,330,500 | 5/1982 | Mackes . | |
| 4,873,802 | 10/1989 | Dahowski . | |
| 4,876,833 | 10/1989 | Gefroh et al. . | |
| 4,896,467 | 1/1990 | McGinnis . | |
| 4,899,646 | 2/1990 | Maras . | |
| 4,936,713 | 6/1990 | Miner | 405/286 |

OTHER PUBLICATIONS

Uniform Building Code 1985 Edition, published in 1985, chap. 12, pp. 71–73 and Appendix p. 743, and chap. 33, pp. 554–565.

National Fire Protection Association Life Safety Code Handbook, chap. 22, pp. 945–958 and chap. 30, pp. 1133–1137.

Scientific American, Nov. 27, 1886, p. 344.

*Primary Examiner*—David A. Scherbel
*Assistant Examiner*—Robert Canfield
*Attorney, Agent, or Firm*—Luke Santangelo

[57] ABSTRACT

A modular areaway system is disclosed having independent side wall members and independent step facings. The modular system allows quick and easy construction of units without the use of extra tools. The independent sections are detachably connectable to one another to form the final single unit assemblage. The means for detachably connecting is integral in part to each independent section of the areaway system. Male and female connectors are disposed on each section to make assembly of each unit by most any person simple and easy, as no tools are necessary. The modular system allows for replacement of sections rather than requiring replacement of entire units. In the event that any individual section is damaged or worn replacement of that section is easily replaced with a new section by detaching the damaged or worn section and reattaching the new section in its place. The modular system allows for varied widths of the areaway system by replacing one size step facings—as the step facings dictate the width of each unit—with a smaller or larger sized step facing. The modular system allows for conservation of space during transportation and storage. Each of the sections may be nested together with similar sections (i.e., the side wall members together, and the step facings together) in a space much less than that required for storing and transporting complete, assembled units.

35 Claims, 10 Drawing Sheets

MODULAR ACCESSIBLE AREAWAY SYSTEM

BACKGROUND OF THE INVENTION

Generally this invention relates to the field of areaways, the enclosures for basement windows. More specifically, the invention relates to modular areaway escape systems. The invention concerns improvements to areaway designs which allow for simple assembly and replacement of sections. These improvements make the present areaway system useful and appealing to residential and commercial users.

For more than a century the technique of allowing light in through a basement window has existed in order to make the space more desirable and made it meet other requirements. In large part the technique has been accomplished through the use of a monolithic areaway to surround the bottom and sides of the basement window to hold earth away from the window so that light can be admitted. An early effort in this regard is shown in U.S. Pat. No. 300,654 to Smith for an "area window protector" first patented in 1884. Many other areaway designs and improvements have been patented since that date. In almost every one of these designs, the focus has been to provide a design which admits light and which excludes earth. The latter of these goals has been met with varying degrees of success. Often elaborate designs have been proposed, including some which are formed as an integral part of the foundation surrounding the basement window. Perhaps because of this focus designers of areaway systems have failed to see the value of a modular design with independent sections. Even with the most elaborate designs, none have addressed the need for making a system which may be assembled "on-site" or the need for a system which allows damaged or worn sections to be replaced.

In recent years it has been discovered that the areaway was also useful as an escape avenue in the event of fire or some other catastrophe U.S. Pat. No. 3,999,334 to Webb describes an areaway entitled "Webb Basement Window Escape." Although not a true areaway but an extension of basement space beyond the foundation wall, this 1976 patent appears to be the first to recognize that the basement window could be useful as a means of escape. Although—with the benefit of hindsight—it may at first glance appear surprising that it took almost 92 years to improve a product similar to an areaway to allow it to become a means of escape, this delay makes sense when it is understood that those skilled in the art of areaway construction tended to improve existing designs in small degrees rather than to freshly innovate to overcome undesirable limitations. This is why until U.S. Pat. No. 4,876,833 to the inventors of the present invention the seemingly simple combination of allowing for an escape system and utilizing the space within the areaway for aesthetic and practical purposes has not been proposed. The present invention accomplishes this goal as well. Those skilled in the art were usually primarily practical people who sought to overcome one perceived problem rather than people who completely re-thought areaway systems.

The present invention focuses on the desirability to allow not only additional safety features to be incorporated within an areaway, but also to provide some designs which, rather than requiring complete installation of a new system when damage or wear begins to show allows replacement of just the damaged or worn sections. In addition to achieving these goals, embodiments of the present invention have been designed with features that accommodate the perspectives of not only the consumer, but also the supplier, the installer, and the manufacturer.

In addressing each of the various perspectives of those involved with the product from its manufacture through its replacement, various independent desires have been especially accommodated by the modular design. With respect to the consumer, the present invention allows for a cost effective areaway system by permitting replacement of less expensive sections. In addition, the design still avoids the difficulties of maintaining the space and providing for drainage inside the areaway as described in the Applicants' previous patent. With respect to both the supplier and the manufacturer, the design allows for a construction which is not only easily manufactured, but which allows individual sections to be nested together for shipping and storage. With respect to the installer, the design avoids any need to integrate the areaway with the foundation so that simple installation and, perhaps more commercially significant, simple replacement of components can be easily accomplished. In this fashion the design is adaptable to existing structures, and is especially suited for replacement of existing areaways. Prior to the present invention, no solution to these various goals was accomplished by any one areaway design.

Another key element of some embodiments of the present invention was the recognition that in earlier unitary bodied inventions retrofitting to existing mounts was sometimes difficult if widths differed greatly. The present invention permits a variety of widths to be accomplished by altering the manufactured dimensions of a minimum number of sections. Larger or smaller areaway systems could then be accomplished by the installer by replacing the key sections. This aspect presents a significant effort and cost savings to the consumer, installer and manufacturer. Attempts by those skilled in the art were simply inadequate because they focused on other problems in the art, or were willing to cope with the particular problems addressed by the present invention. The degree to which these seemingly simple recognitions are significant seems apparent when one considers that the present invention, although unexpectedly simple in achieving these goals and overcoming the limitations of the prior art, has not been available even though areaways have existed for over one hundred years.

U.S. Pat. No. 4,876,833, issued Oct. 31, 1989, to the same inventors is hereby incorporated by reference.

SUMMARY OF THE INVENTION

It is broadly an object of the present invention to provide a design which allows for simplistic construction of an areaway. It is therefore a further object to provide a modular design with individual sections designed to be easily connected together to form the desired areaway system. An object is thus to provide a design with uncomplicated connecting means.

A further object of the modular design is to allow components to be changed, replaced, or up-graded with only a minimal amount of time, cost and effort. It is thus another object of the design to allow individual sections to be detached from the areaway to allow for replacement.

It is also an object of the present invention to accommodate the needs of retailers by minimizing storage and shipment requirements such as space and inventory.

It is a further object of the present invention to allow the modular device to be fitted to many varying sizes and shapes of basement windows. It is thus an object of the present invention to allow various sized and shaped sections to be interchangeable with each other.

A further object of the present invention is to allow for nesting of each of the individual sections together with similar sections to simplify storage and transportation of the areaways prior to installation.

It is a further object of the present invention to provide a design which allows for escape features in an areaway which can be easily retrofitted to existing structures. An object is also to provide a design which can be easily installed in new structures. An object of the design is not only to provide for escape, but also to provide for access by emergency personnel through the areaway. Such access is provided in a useful fashion which accommodates the inherent equipment and needs of such emergency personnel.

It is a further object of the present invention to provide for designs which accommodate the various perspectives of those persons coming in contact with the areaway. Such perspectives include the perspectives of manufacturer, supplier, builder, installer, building owner, occupant and emergency personnel. An object of the present invention is to accommodate each of these perspectives in one simple design which balances the various competing interests.

It is a further object of the present invention to provide for an areaway design which allows access to the earth surrounding the areaway. An object of the present invention is to provide a design which allows planting within the areaway.

It is further object of the present invention to simplify the installation of areaway escape systems. An object is thus to accommodate new structures and to allow for easy replacement of existing areaways. An object is also to simplify installation by allowing for access to the earth surrounding the areaway from within the areaway itself. An object is thus to avoid having to install the areaway and backfill from behind the areaway after it has been attached to the structure. Another object is to provide a design which does not require modification to the existing structure in order to accomplish installation of the areaway escape system. It is thus an object to allow for installation which is easy enough to be accomplished by a homeowner in residential applications.

It is further object of the present invention to provide an escape system which is outside the living space of a building. An object is to provide an areaway which need not be integrated into the foundation of a building and which may separated from the interior space of the building through existing windows and the like. A further object is to accommodate conventional grading and slopes away from the structure. Similarly an object is to provide for a device which may be simply manufactured which also achieves the various aims mentioned.

Naturally, further objects of the invention are disclosed throughout other area of this specification and claims.

DETAILED DESCRIPTION OF THE PREFERRED EMBODIMENTS

Figure 1:
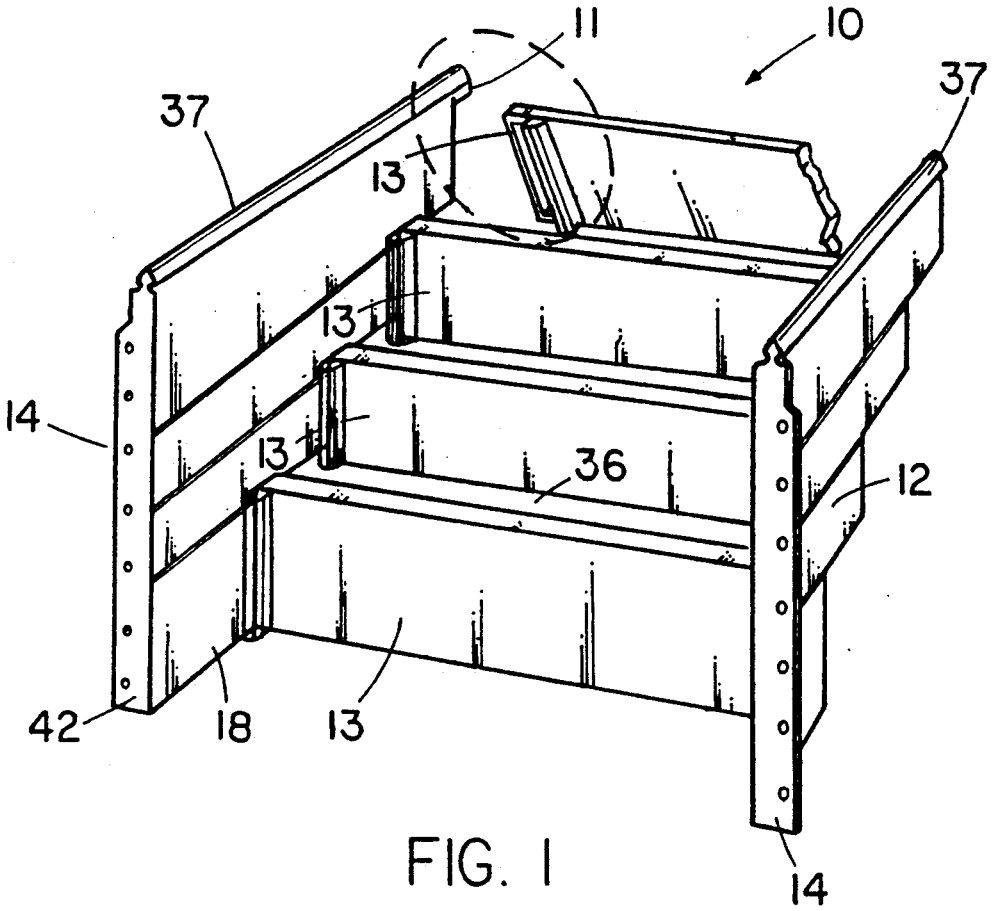
FIG. 1 is a perspective view of an embodiment of the invention.

As can be seen from the drawings, the basic concepts of the present invention may be embodied in many different ways. FIG. 1 shows one embodiment of modular areaway system (10) in perspective. The modular or sectional design of the present invention includes independent first and second side wall members (11 and 12, respectively), and independent step facings (13). By "modular" and "sectional" it is meant that the invention is designed in sections which are assembled to produce the desired product. Likewise, by the term "independent" it is meant that each section operates separately until connected in some manner to other sections. By providing a modular assembly, manufacturing and cost efficiencies are gained allowing the invention to meet the objects of an efficient, cost effective design from various perspectives. Not only is manufacturing more easily accomplished, but it can be accomplished in a less expensive manner. Equally important, installation, replacement of individual sections, and transportation and storage are greatly facilitated. Some aspects of the present invention are disclosed in the incorporated reference U.S. Pat. No. 4,876,833 to the same inventors. The manner in which most of these aspects are accomplished by the invention disclosed in U.S. Pat. No. 4,876,833—a unitary body design—is very different from the modular design of the present invention.

Figure 3A:
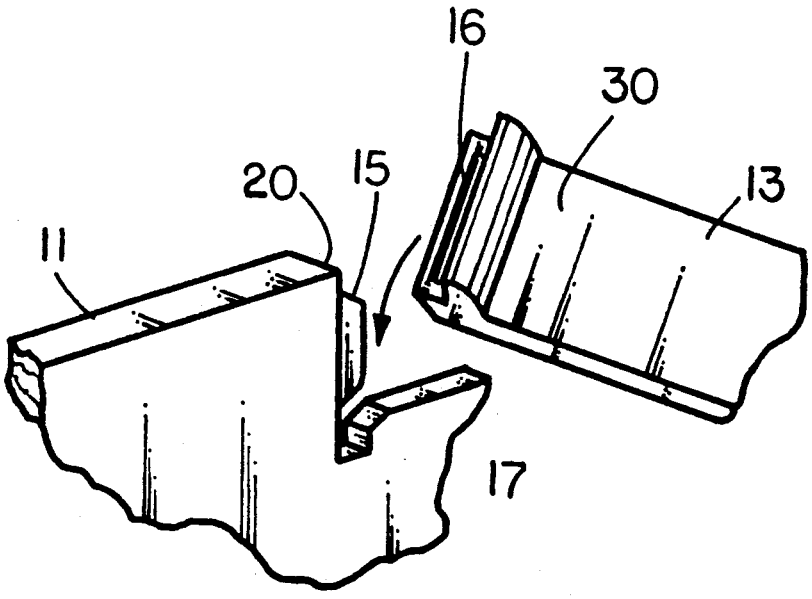
FIG. 3*a* is an enlarged view of the connecting means between the side wall members and the step facings as shown by the circle in FIG. 1.
Figure 3B:
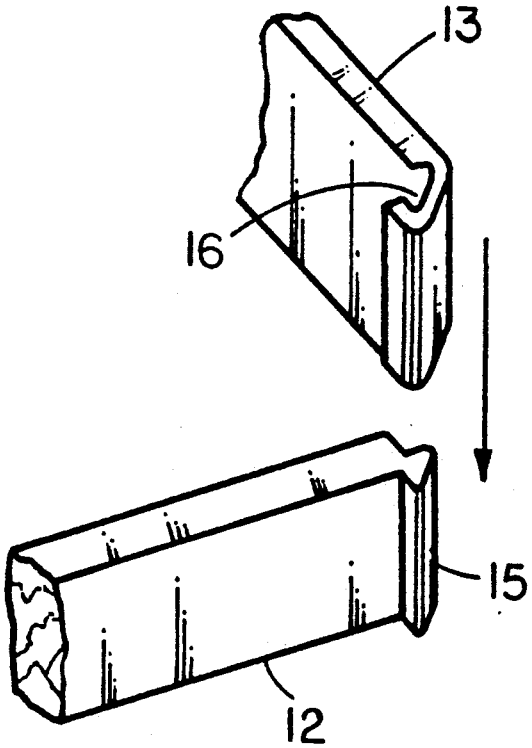
FIG. 3*b* is an enlarged view of another possible connecting means between the side wall members and step facings.
Figure 5:
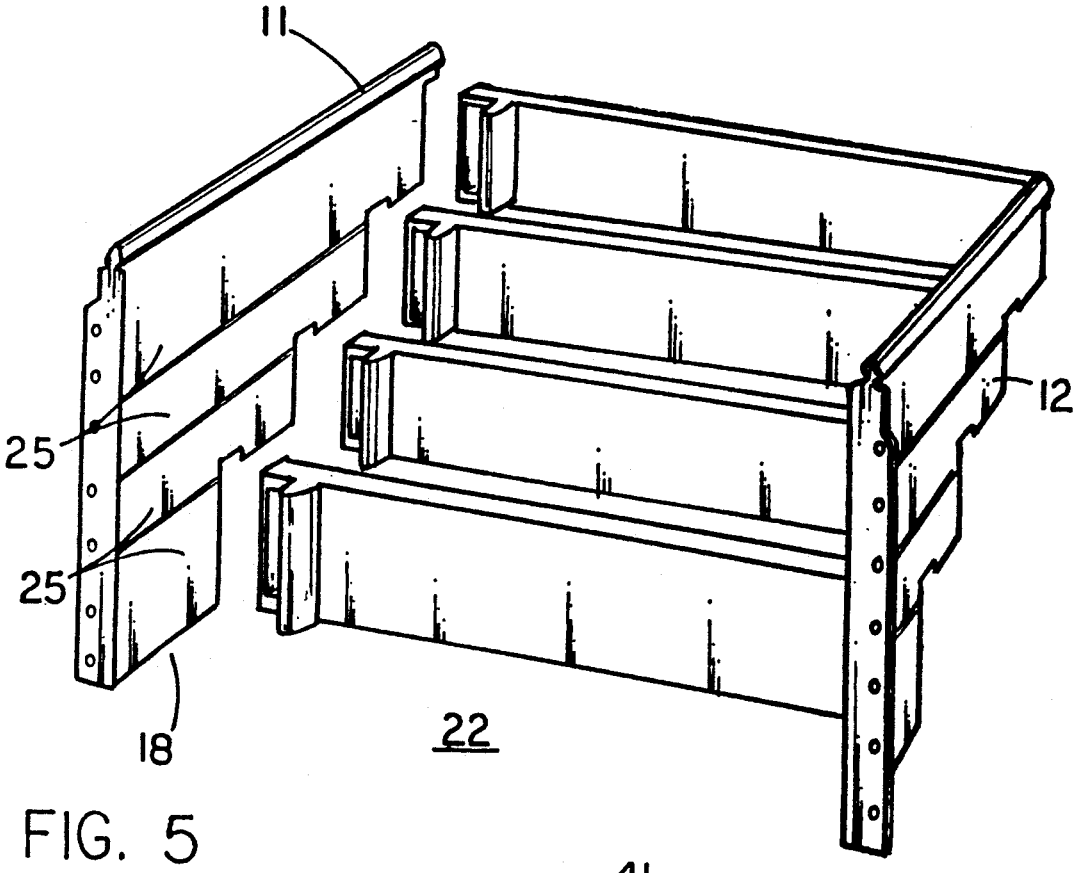
FIG. 5 is an exploded view of the embodiment shown in FIG. 1.

FIGS. 3*a* and 5 show a more detailed view of first and second side wall members (11 and 12) and step facings (13) and the means for detachably connecting. Each side wall member (11 and 12) is designed to have an integral male connector (15) located on external face (20) of each tier (25). Similarly, each step facing (13) is designed having female receptors (16) located on each end of internal face (30). FIG. 3*a* shows a design in which male connector (15) is a tab-like projection, while female receptor (16) is an L-shaped recess. FIG. 3*b* shows a possible alternate design. To assemble, female receptors (16) are attached onto male connectors (15), a single step facing (13) for each tier (25). Naturally alternative designs may have connector (15) and receptors (16) switched between step facing (13) and side wall members (11 and 12). Other alternative designs may modify this means for detachably connecting in any number of ways to facilitate the attachment between side wall members (11 and 12) and step facings (13). Such variations include, but are not limited to, sliding interlocking connectors (as shown in FIG. 3*b*), interlocking connectors, and conventional bolts, or screws. Also shown in FIG. 3*a* is notch (17) adjacent to each male connector (15) of side wall members (11 and 12). Notch (17) tapers from its open end towards its closed end to perform a two-fold function. First, it aids connection by allowing step facing (13) to be inserted into notch (17) at an angle and pivoted to engage female receptor (16) with male connector (15). Second it, together with the backfill to be discussed later, serves to retain step facings (13) in the desired attachment position. The taper of notch (17) is preferably designed so that it frictionally engages step facing (13) when vertical. In the event that other connecting means are used to attach step facings (13), notch (17) may be omitted from construction. The unique design, interrelation and function of male connector (15) and female receptor (16)—the preferable means for detachably connecting—is beneficial in many ways besides its quick and easy use. It does not need metal nuts, bolts, or such which are very prone to rust, especially under the conditions present underground. This also negates the need for any tools for assembling areaway (10). Aesthetically, the design shows a single seam formed between the connection of side wall members (11 and 12) and step facings (13). The present design may also inhibit the infiltration of dirt from the exterior into the means for connecting, as this could detract from the appearance of areaway (10) and the function of male connector (15) and female receptor (16).

An important feature of areaway (10) is that it be designed to attach to the exterior of the foundation of a building without significant alteration of the foundation. This is accomplished through foundation flanges (14). Although some designs for an areaway escape system have required significant alteration of the foundation, the present invention affords easy attachment to the foundation by providing numerous holes in foundation flanges (14) so that height and attachment may be easily adjusted and accomplished. This allows utilization of the present invention in situations where prior areaways are replaced. Unitary body construction areaways do not allow for adjustment to wider or narrower window sizes in cases of replacement. This limitation is addressed in the present invention. When areaway system (10) is assembled, the area between foundation flanges (14) forms a vertical opening which is adjacent to foundation face (42) of side wall members (11 and 12) when installed. This opening may be adjusted in a manner which will be discussed later to accommodate existing window structures of various widths. Foundation flanges (14) may be outward facing as shown in FIG. 1, or inward facing (not shown). This aspect is possible due to the modular design of the present invention. Side wall members and 12) are interchangeable, and therefore may be positioned on either the left or right side of areaway (10) when assembled, permitting inward or outward facing flanges (14).

Figure 2:
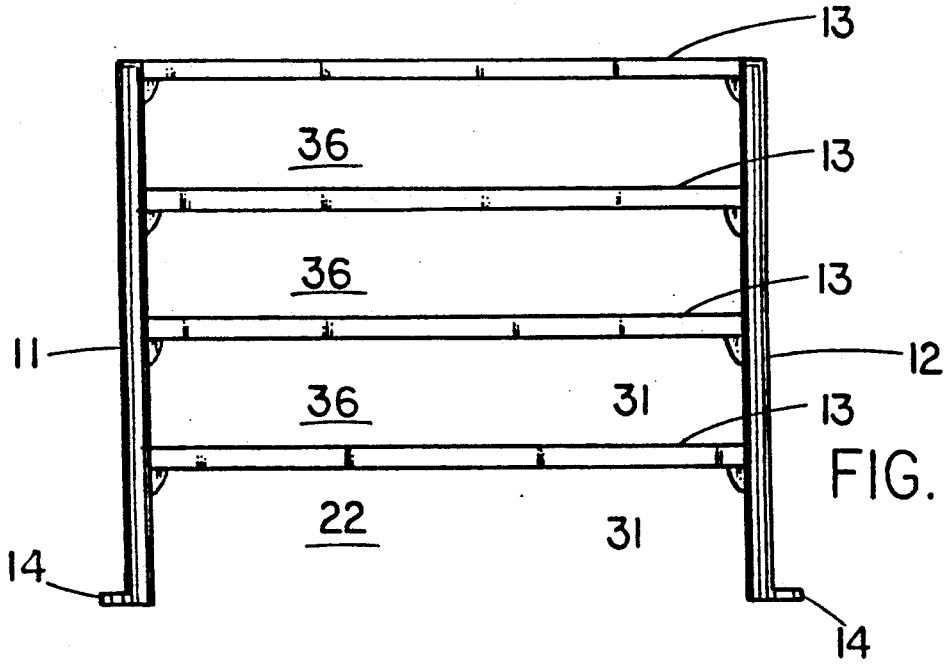
FIG. 2 is a top view of the embodiment shown in FIG. 1.

A feature of the present embodiment is the fact that bottom edge (18) of side wall members (11 and 12) creates floor opening (22). Floor opening (22) may serve as a drain for areaway (10). In providing an open area rather than a fixed drain design, users and installers of areaway (10) can incorporate any particular type of drain mechanism they desire. For instance in FIG. 2, a "french drain" design is shown. Additional drainage is created by offsetting each tier (25) of side wall members (11 and 12) to enhance drainage into step openings (36). These horizontal areas are typically called the "tread" of the step by those skilled in the art. In addition, concrete floors even with plumbed drains or planting are certainly possible through this feature of the present embodiment, the essence of such a feature being that it can accommodate a broad variety of drain designs. In addition to the floor drain, it can be seen in FIG. 4 that step facings (13) form the "riser" of steps (31) within the areaway. This aspect serves as an escape means. Step opening (36) is located perpendicularly to the riser. Opening (36) serves not only as an additional drain mechanism, but also as a means for accessing the earth below the areaway and as a means for planting within the areaway.

Referring again to FIG. 2, a top view of the embodiment shown in FIG. 1, it can be seen that openings (36) form a substantial amount of the area of each horizontal step (31). Although simple provision of a small drain tube could be utilized, by providing opening (36) which is larger than that merely necessary to allow water drainage, the present invention accommodates several needs. The provisions for such openings throughout areaway (10) are discussed in U.S. Pat. No. 4,876,833, to the same inventors. Those skilled in the art typically felt that in order to be commercially acceptable areaways must exclude earth to the largest extent possible. As an example, U.S. Pat. No. 2,453,609 for an "Areaway Wall" states that it relates to walls which define an areaway and which prevents substantially all infiltration of earth into the areaway. Although at first it might seem like a simple modification to depart from this preconception, those skilled in the art had simply not questioned the need and thus were limited in their designs. By leaving the tread of each step (31) open in the described manner the modular design allows for the desired removal of individual sections. Perhaps more importantly, it allows for the replacement of individual sections without total removal of areaway (10).

The step openings (36) not only serve as a means for draining areaway (10), or a means to allow proper installation and replacement of individual sections, but they also permit planting within areaway (10). As alluded to earlier by allowing access to the earth behind areaway (10) through openings (36), installation and replacement is greatly facilitated. While excavation of the earth surrounding the foundation of a house is necessary, once areaway (10) is installed the problem of backfilling the earth was difficult for areaways which were not simply vertical walls. Since support of the areaway by the earth is a very beneficial structural aspect with the modular design, backfilling under the areaway was a problem for some designs. The present invention solves this problem through step openings (36). After attachment of assembled areaway (10) to the foundation through foundation flanges (14), the installer may then simply backfill areaway (10) through step openings (36). This allows for proper compaction and enhances the structural and support needs of areaway (10) thus minimizing the torsion on foundation flanges (14). This is significant because it allows the implementation of a simple escape device in situations where prior art had required involved measures including even reconstruction of edges of the foundation. When replacement of an individual section is warranted the backfilling ma be simply removed through opening (36). Removal allows for the detachment of each step facing (13), if side wall member (11 or 12) is to be replaced, or just a single step facing (13). An ancillary benefit of the backfilling process is that the dirt, or other material piled against step facings (13) serves to aid in their retention to side wall members (11 and 12).

In addition, step openings (36) also allow the capability of planting within areaway (10). Although most areaways serve solely to admit light and in so doing create a volume of space which is basically undesirable, by allowing planting within areaway (10), the present embodiment enhances the aesthetic appeal of areaway (10) and even integrates the volume of space within areaway (10) into the aesthetic surroundings of the interior living area. In the present invention this volume of space is not integrated as part of the interior living area. This is significant in that it allows areaway (10) to be incorporated in existing designs where basement windows are utilized with minimal or no modification.

As can be seen in FIGS. 1 and 5, a great benefit of the modular system is their potential for maximum space utilization during storage, transportation and packaging. Side wall members (11 and 12) are designed with offset tiers which allow side wall members (11 and 12) to be nested together. Although each side wall member (11 and 12) is shown to be straight it may be desirable to design members (11 and 12) to curve. This may be done for mere aesthetics, or to further facilitate the nesting together of these sections. Similarly, step facings (13) are easily and compactly stored when disassembled from areaway (10). The benefits of this aspect affect the manufacturing of areaway (10) and the inventory requirements of the supplier of areaway (10) in a positive manner. Not only is manufacturing of smaller sections now possible, but each smaller section can be stored in a smaller area. Certainly a variety of nesting aspects could be included such as tapers on other surfaces or curved sections and still be within the scope and spirit of the present invention.

Figure 4:
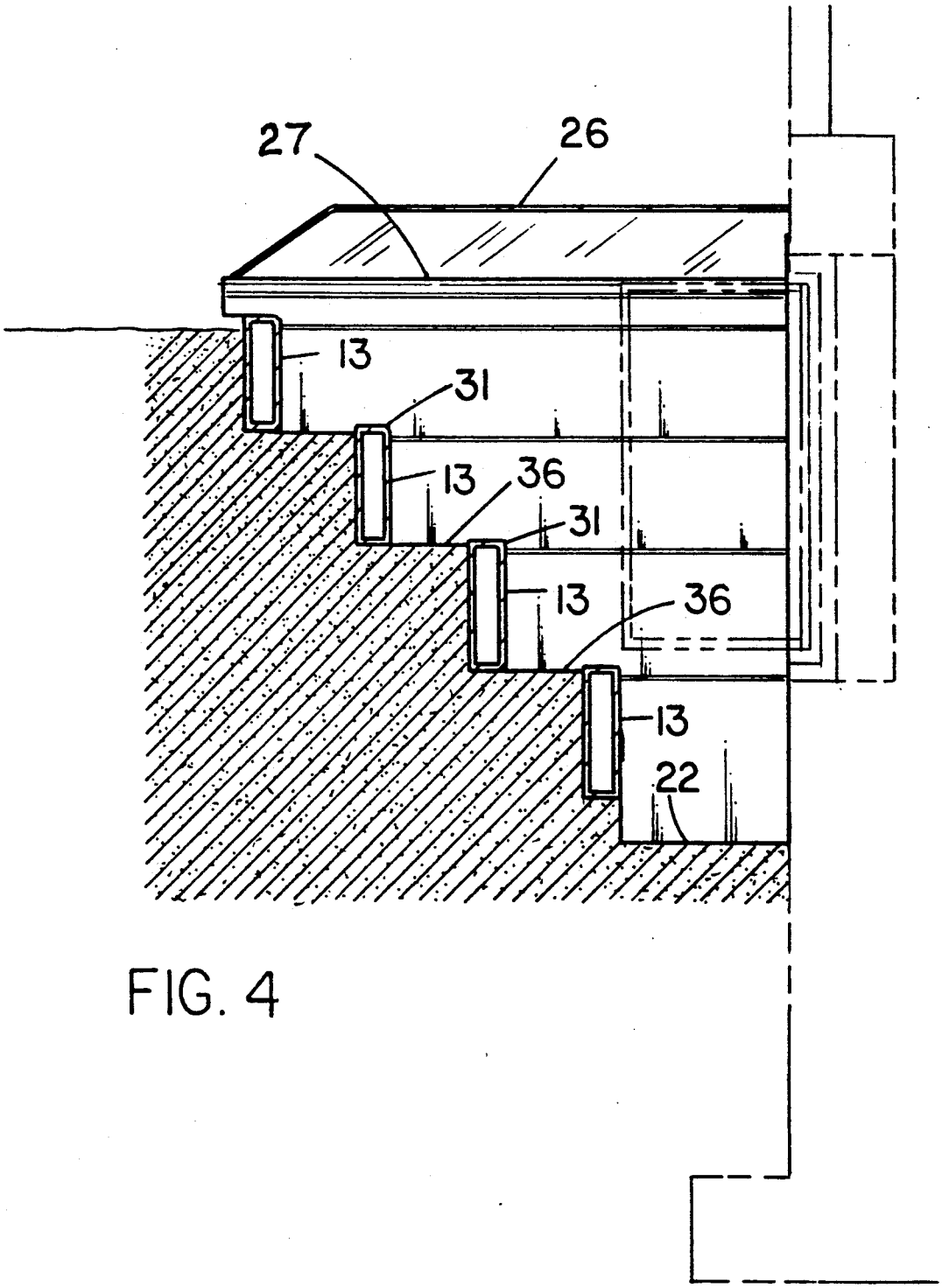
FIG. 4 is a cross-sectional side view of the embodiment shown in FIG. 1 as it would look when attached to a foundation.

Referring to FIG. 4, additional features of the areaway can be understood. Areaway (10) is attached to the foundation at foundation flanges (14; not shown). Such attachment may be through any number of means including bolting the areaway directly to the foundation. Since present areaways often utilize similar flanges, attachment is easily accomplished to existing mounts when an old areaway is replaced. However, because of the modular design of the preferred embodiments, only damaged or worn sections of areaway (10) requiring replacement need be replaced. This provides a great economics benefit to the consumer.

A further feature of this embodiment is the fact that the lowest horizontal step facing (13) may be designed to be lower than the bottom edge of a basement window after installation. This allows additional space for opening the window in the event casement or other such designs are utilized. Such a window is shown in the open position in FIG. 4.

In providing a series of open steps, the present invention allows a positive means for escape through areaway (10). In addition, by providing a relatively wide floor opening (22) and by providing a large upper opening (27), areaway (10) allows not only for egress from the building but also for ingress as may be necessary for emergency personnel. A proposed change to uniform building codes states that areaways shall supply "sufficient horizontal dimensions to inscribe a circle with a diameter not less than 30 inches", this horizontal area extending "the full vertical height" of the areaway. This aspect is significant because the majority of areaway designs are not sufficiently wide to allow rescue operations through the opening. Certainly this would include the ability to wear oxygen tanks and carry similar equipment into the structure through areaway (10). The 30 inch inscribed circle is just a proposed code change. Certainly dimensions of less than 30 inches are also possible and are considered to fall within the scope and spirit of the present invention.

As mentioned earlier, in contrast to the inventors' previous design, a modular or sectional construction is preferred. In the preferred embodiments, manufacture can be easily accomplished through the rotational molding process. Each individual section could be mass produced to satisfy inventory requirements, or upon consumer demand. The molded sections may be of a hollow double-walled construction, but may be filled for added weight and strength. A chemical foam filler is one example of a filler that may be used with the present invention. Others include recyclable materials, cement, and the like. Additional supports, commonly called "kiss-offs" in the art, are molded within each section connecting exterior surface (A) to interior surface (B). Naturally, color and other aspects can be included to customize areaway (10). Certainly other manufacture methods well-known to those skilled in the art are possible. Injection molding, blow molding, resin transfer to name a few. Solid construction and single-walled construction are also possible alternatives when utilizing some of these other manufacturing techniques commonly known. Each of these alternative manners of construction and manufacture are considered to fall within the scope and spirit of the present invention.

Figure 6:
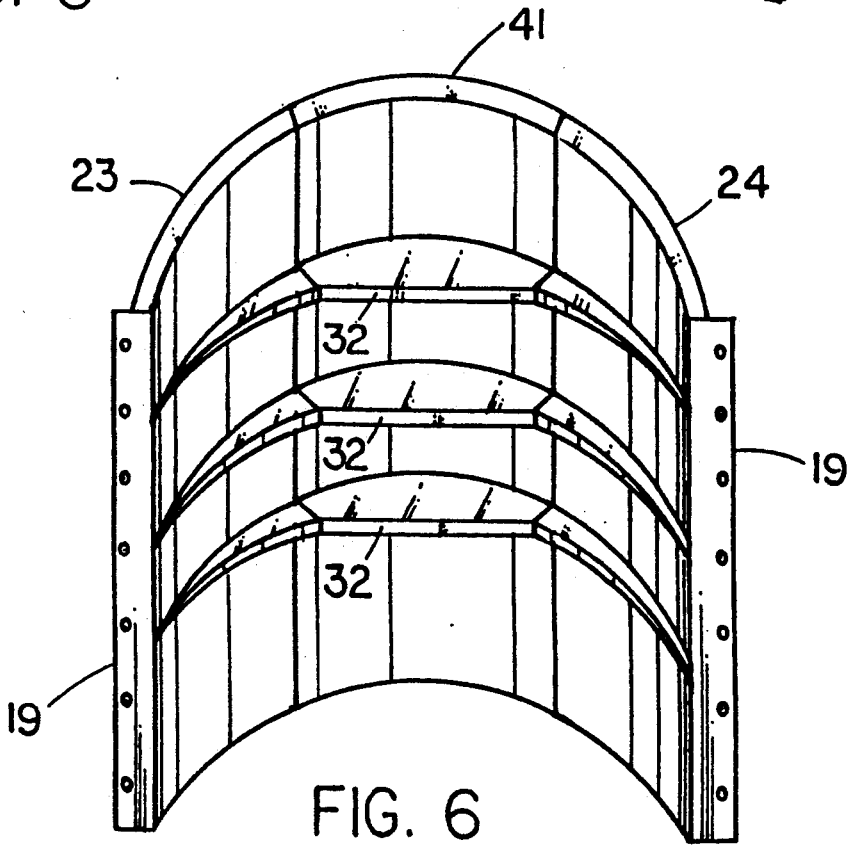
FIG. 6 is a perspective view of another embodiment which includes a substantially vertical retaining member.
Figure 8:
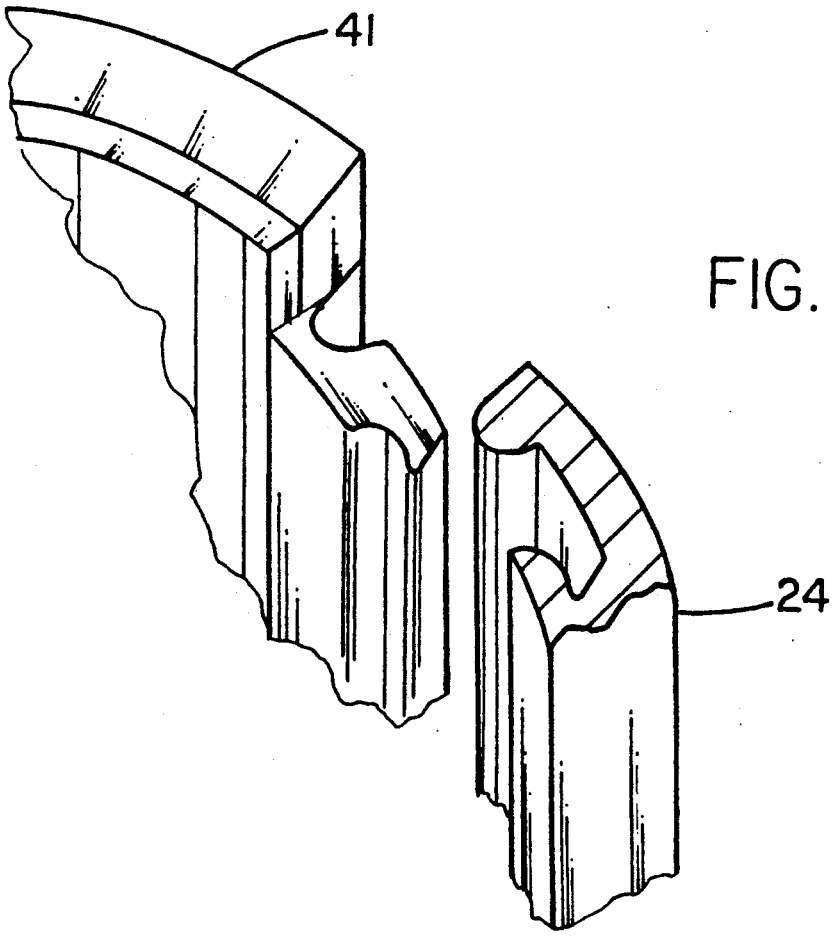
FIG. 8 is an enlarged view of the connecting means between the vertical retaining members.

Referring to FIG. 6, another embodiment of the present invention can be seen. FIG. 6 presents a simplified modular embodiment which provides for a means of escape in an areaway which may be easily retrofitted to existing designs without modification of the foundation. Such attachment is accomplished as before through foundation flanges (19). The means for escape comprises a vertical series of horizontal steps (32) which are molded into a middle vertical retaining member (41). End vertical retaining members (23 and 24) are adjoined to retaining member (41) in much the same manner as described in the first embodiment. FIG. 8 shows one possible design for connecting retaining members (23, 24 and 41). Certainly other designs, as described earlier, are possible to effect this connection and would still fall within the scope and spirit of the present invention. As a means for customizing the present embodiment to existing window sizes vertical retaining member (41) may be designed in various widths. Certainly, any number of vertical retaining members (41) may be used to accomplish the desired width as well.

A possible alternative to the embodiment of FIG. 6 may be a design which excludes vertical retaining member (41). In this instance vertical retaining members (23 and 24) would connect together, and steps (32) would be molded into members (23 and 24). The integrally molded steps (32) may be positioned anywhere on retaining members (23 and 24) and may naturally be either positive steps as shown, or negative inserts. Naturally, because each retaining member (23 and 24) might contain only half of step (32) the retaining members should be designed so that the portions of steps align to create full steps (32).

Since molded steps (32) extend either little or no distance beyond retaining members (23 and 24), backfill underneath each step may or may not be necessary. As with the previous embodiment, floor opening (21) may serve as a planting means. The embodiment may also be specifically designed to modify current areaway structures to the smallest extent possible to address users accustomed to existing designs or who prefer the features of such existing designs. In designing molded steps (32), certainly various shaping differences could be provided and yet would still fall within the scope and spirit of the present invention. Handles could be included through different molding of the steps, however, such have not been included in the present design as a most simplified version has been sought. In like fashion, retaining members (23 and 24) can have different shapes and textures.

Figure 7:
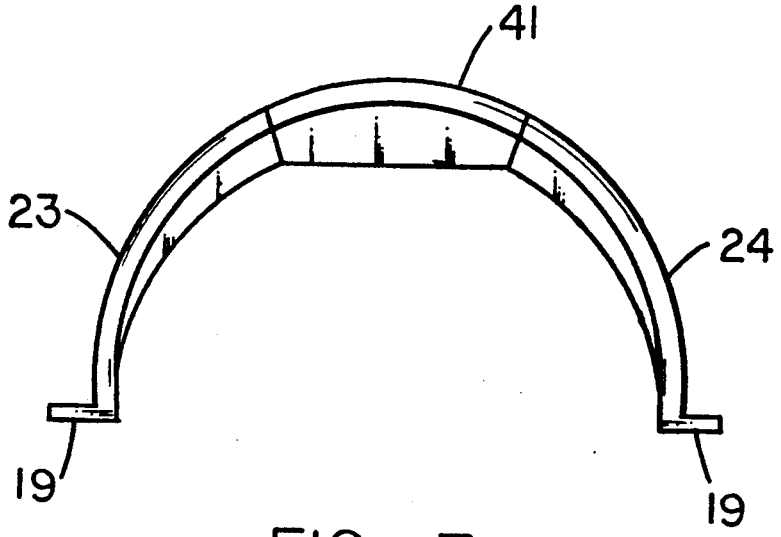
FIG. 7 is a top view of the embodiment shown in FIG. 6.

FIG. 7 shows a top view of the embodiment shown in FIG. 6. As can be seen, molded steps (32) need only comprise a sufficient amount of area to provide a positive means for escaping. The horizontal dimensions of this embodiment may conform to the above mentioned building code by providing an area capable of being inscribed with a circle having a diameter of not less than 30 inches.

Figure 9:
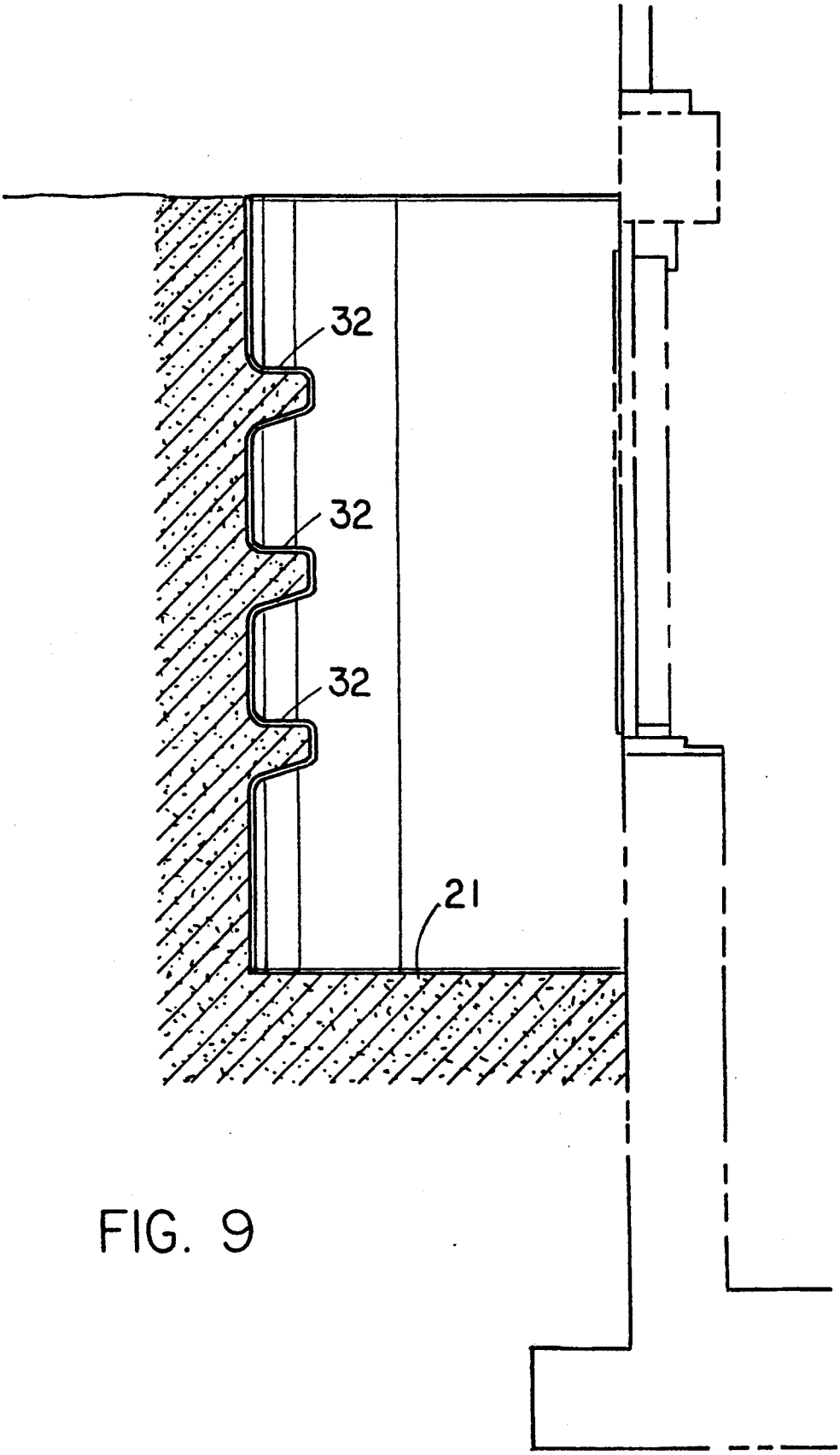
FIG. 9 is a cross-sectional side view of the embodiment shown in FIG. 6 as it would look when attached to a foundation.
Figure 10:
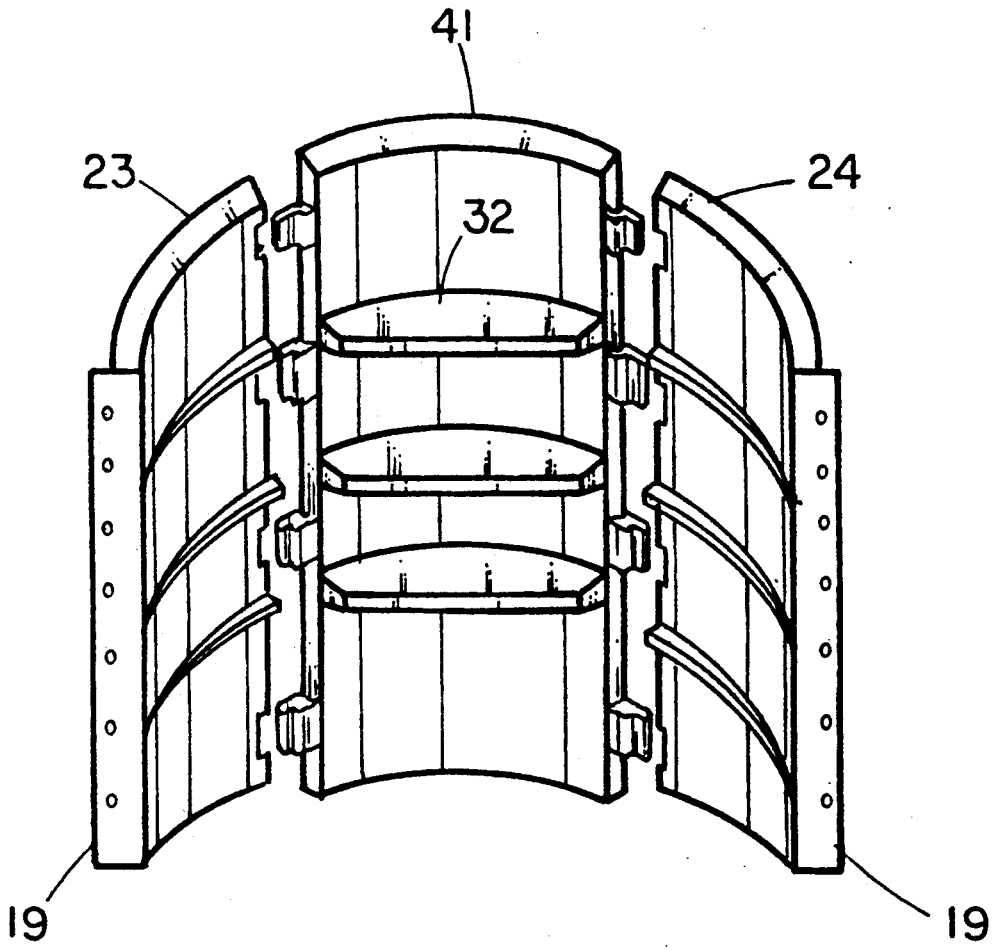
FIG. 10 is an exploded view of the embodiment shown in FIG. 6.

As shown in FIG. 9, this embodiment may also be mounted to the foundation by bolting through foundation flanges (19). The bottom of the areaway creates floor opening (21) which serves as a drain and may be utilized in any number of fashions as mentioned earlier. Again, a french drain is shown with gravel inserted.

Figure 11:
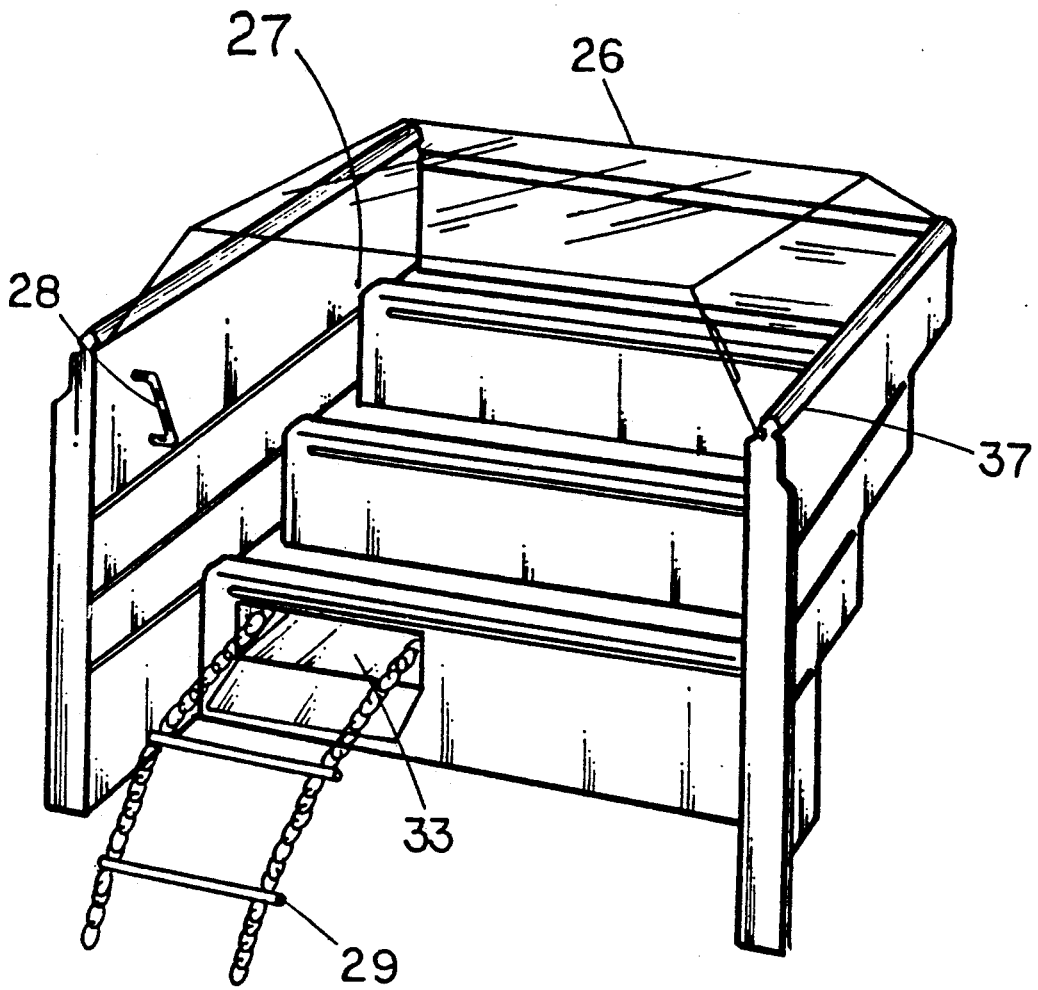
FIG. 11 is a perspective view of another embodiment which includes additional features.

Referring to FIG. 11, an additional embodiment incorporating several separate features is shown. First, an areaway cover (26) is shown over upper opening (27). Areaway cover (26) not only serves the conventional purpose of excluding the elements while admitting light to the areaway, but it also enhances embodiments of the present invention which allow planting by creating a greenhouse effect. Cover (26) is preferably detachably connected by a "snap-on/snap-off" design. Hinging or some other attachment technique may be utilized, but areaway cover (26) should not be permanently fixed to upper flange (37) as both ingress and egress in emergency situations must be allowed.

As an enhancement to the means for escape, handles (28) may be added to the upper area of either or both side wall members (11 and 12). Handles (28) would be angled to assist a person in accessing areaway (10) and escaping from the interior space. Since the vast majority of basement windows are raised somewhat from floor level, handles would assist the person in extricating themselves through the basement window. In addition, a ladder (29) could be provided. While certainly ladder (29) could be stored externally and attached to areaway (10) or the foundation through some attachment means, ladder (29) such as a rope ladder could be integral to areaway (10) through the use of some compartment (33). Naturally compartment (33) could be a variety of designs, one possibility being the openable compartment as shown in FIG. 11.

Figure 12A:
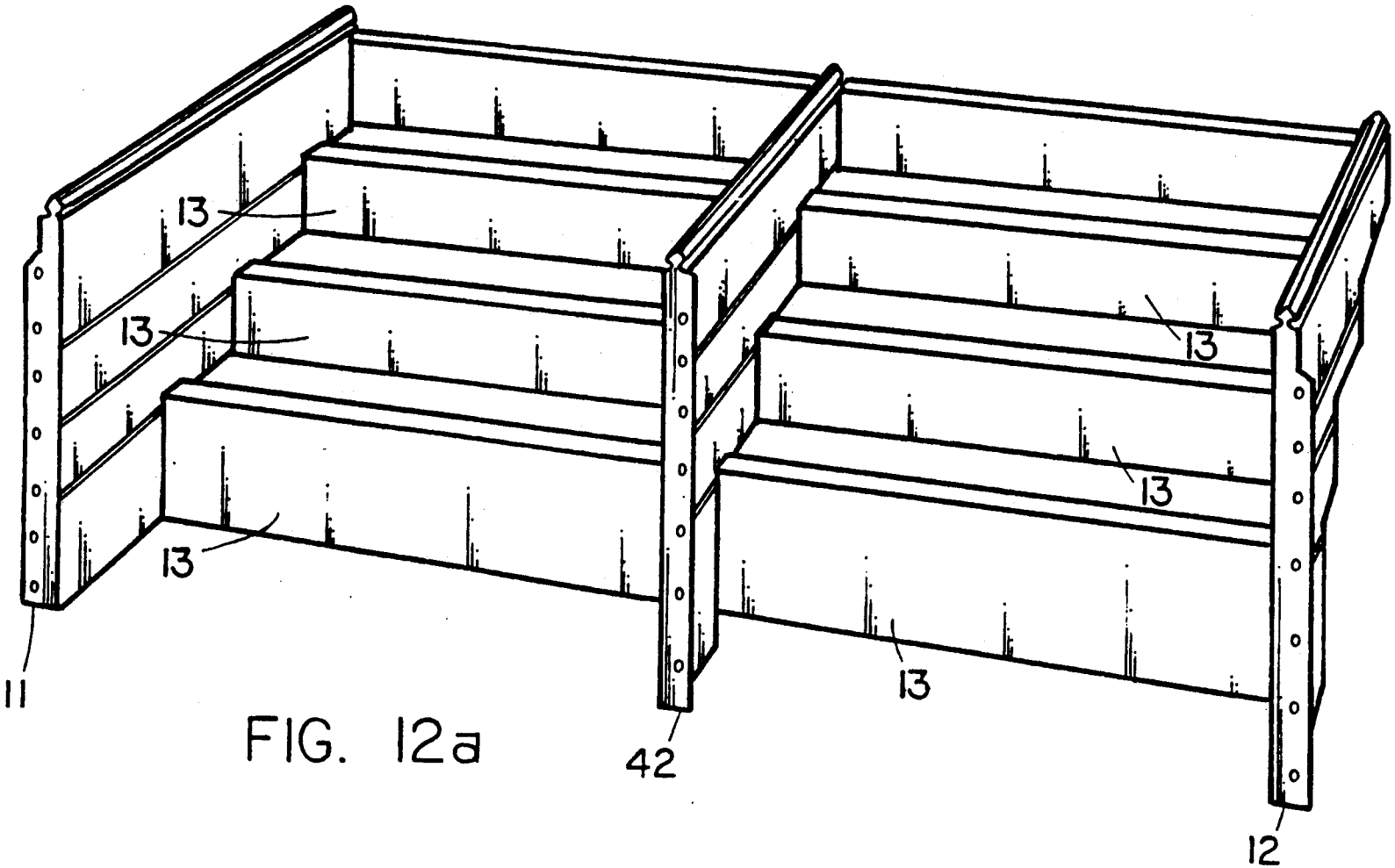
FIG. 12*a* is a perspective view of two areaways connected in series.
Figure 12B:
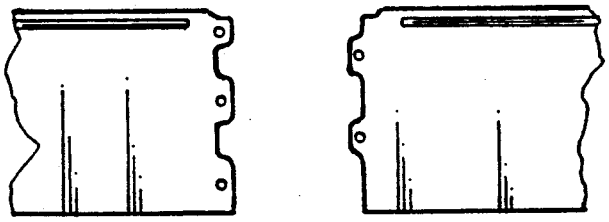
FIG. 12*b* is an enlarged view of the "dovetail" connectors used for linking units in series.

In FIG. 12*a* two areaways connected in series are shown. Since it may be desirable to have several basement windows, the embodiment shown lends itself to a means for connecting areaways (10) in a series. One of side wall members (11 or 12) becomes a center connecting support. Through the use of interlocking connectors on step facings (13) two units may be connected using only 3 side wall members (11, 12 and 42). FIG. 12*b* shows opposite ends of a step facing (13) having "dovetail" connectors as one type of interlocking connector. Although this method provides a simple connection technique, certainly other connections are possible. This type of connection has been chosen based upon the goal of providing a simple device at the outset. The use of single center side wall member (42) as shown in FIG. 12*a* serves to integrate the two units and is a simple device. More units may be similarly attached in series to create a longer integrated unit if necessary.

Figure 13:
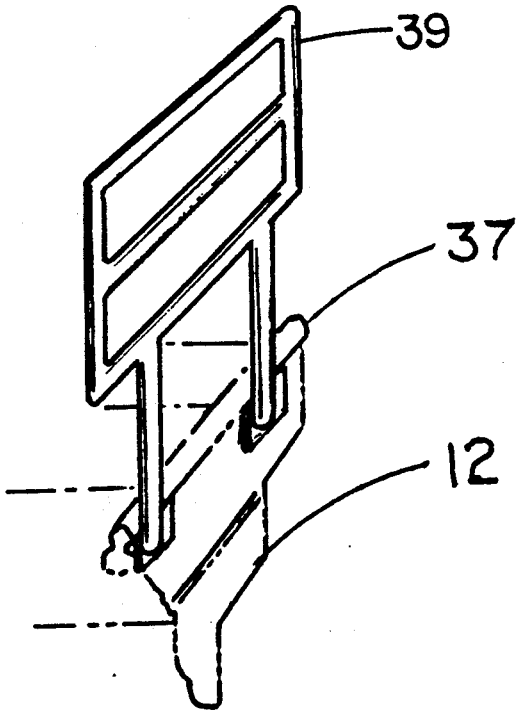
FIG. 13 is an perspective view of an embodiment having a railing attached.

Since certain building codes require the use of railings to protect any fall into an areaway, a means to accommodate a railing is shown in FIG. 13. Through well known manufacturing techniques, a mounting guide such as a railing sleeve can be attached to either side wall member (11 and 12) as shown. The railing sleeve could naturally be a metal tube or any other kind of receptacle for railing (39). As shown in FIG. 13, railing could be bolted to the modular side wall members (11 or 12) underneath upper flange (37). Naturally, other structural enhancements could be added including additional sleeves lower on side wall member (11 or 12) and the like. Railing (39) could also be designed to be detachable without bolting it from below upper flange (37).

The foregoing discussion and the claims which follow describe the preferred embodiment of the present invention. Particularly with respect to the claims, it should be understood that changes may be made to the invention without departing from its essence. In this regard it is intended that such changes will still fall within the scope of the present invention. It simply is not practical to describe and claim all possible revisions to the present invention which may be accomplished. To the extent such revisions utilize the essence of the present invention, each would naturally fall within the breadth of protection encompassed by this patent.

I claim:

1. A modular open areaway escape system for a building having a basement window with a height and width, and a foundation, said areaway comprising:

a. independent first and second side wall members, each comprising a top and a bottom edge, a foundation face, and an external face opposite said foundation face;

b. a plurality of independent step facings;

c. a means for detachably connecting each of said step facings to said first and second side wall members;

d. a means along said foundation face of said side members for attaching said side members to the exterior of the foundation of said building adjacent to said basement window without significantly altering the foundation; and e. a positive means for escaping;

f. a means for draining the areaway.

2. A modular open areaway escape system for a building having a basement window with a height and width, and a foundation, said areaway comprising:

a. two end vertical retaining members, each comprising a top and a bottom edge, a foundation face, and an external face opposite said foundation face;

b. a means for detachably connecting each said end vertical retaining member to another vertical retaining member;

c. a means along said foundation face of said retaining members for attaching said retaining members to the exterior of the foundation of said building adjacent to said basement window without significantly altering the foundation; and d. a positive means for escaping;

e. a means for draining the areaway.

3. A modular open areaway escape system a described in claim 2 wherein said means for detachably connecting comprises at least one male connector on one end vertical retaining member and at least one female connector on another said end vertical retaining member.

4. A modular open areaway escape system as described in claim 2 and further comprising at least one middle vertical retaining member.

5. A modular open areaway escape system as described in claim 4 wherein said areaway system has a width, said system further comprising a means for expanding the width.

6. A modular open areaway escape system as described in claim 5 wherein said means for expanding the width is said middle vertical retaining members.

7. A modular open areaway escape system as described in claim 6 wherein each said middle vertical member comprises a means for fastening between each said end vertical retaining member.

8. A modular open areaway escape system as described in claim 7 wherein each said middle vertical member has at least two edges, said means for fastening comprising a male connector on at least one edge and a female connector on at least another edge.

9. A modular open areaway escape system as described in claim 4 wherein said means for escaping comprises:

a. a substantially vertical retention assembly; and b. a plurality of definite steps integral to said retention assembly.

10. A modular open areaway escape system as described in claims 1 or 3 wherein said means for escaping comprises a plurality of steps and said means for draining comprises a drain on each step.

11. A modular open areaway escape system as described in claim 10 wherein said means for escaping has a width and wherein said width is not less than the width of the window.

12. A modular open areaway escape system as described in claim 1 wherein said first and second side wall members further comprise:

a. a bottom tier, extending horizontally along said bottom edge;

b. a top tier, extending horizontally along said top edge;

c. at least one middle tier, positioned adjacently between said top tier and said bottom tier, and wherein said tiers are offset from one another.

13. A modular open areaway escape system for a building having a basement window with a height and width, and a foundation, said areaway comprising:

a. independent first and second side wall members, each member comprising:

(1) a top and a bottom edge, a foundation face, and an external face opposite said foundation face;

(2) a bottom tier, extending horizontally along said bottom edge;

(3) a top tier, extending horizontally along said top edge; and (4) at least one middle tier, positioned adjacently between said top tier and said bottom tier;

b. a plurality of step facings comprising a means for detachably connecting to said external face of each said tier;

c. A means along said foundation face of said side wall members for attaching said side wall members to the exterior of the foundation of said building adjacent to said basement window without significantly altering the foundation;

d. a positive means for escaping; and e. a means for draining the areaway.

14. A modular open areaway escape system as described in claims 1, 2 or 13 and further comprising a means for disassembling said areaway into individual sections.

15. A modular open areaway escape system as described in claim 14 wherein each individual section is replaceable.

16. A modular open areaway escape system as described in claims 1 or 13 wherein said means for detachably connecting comprises a means for affirmatively retaining said step facings to each of said side wall members.

17. A modular open areaway escape system as described in claim 16 wherein said means for affirmatively retaining comprises notches in said bottom edge of each of said side wall members.

18. A modular open areaway escape system as described in claim 17 wherein said step facings have an external surface and wherein said means for affirmatively retaining said step facings further comprises material piled against said external surface.

19. A modular open areaway escape system as described in claim 17 wherein said notches frictionally engage said step facings.

20. A modular open areaway escape system as described in claim 19 wherein each of said step facings is removable from said areaway system through said means for draining.

21. A modular open areaway escape system as described in claim 16 wherein said means for detachably connecting comprises a male connector attached to each of said side wall members and a female connector attached to each of said step facings.

22. A modular open areaway escape system as described in claims 12 or 13 wherein said tiers are integral.

23. A modular open areaway escape system as described in claim 22 wherein said means for escaping comprises said tiers arranged in a step-wise manner.

24. A modular open areaway escape system as described in claim 14 wherein said means for escaping comprises a plurality of steps and said means for draining comprises a drain on each step.

25. A modular open areaway escape system as described in claim 17 and further comprising a cover connected to said top edge.

26. A modular open areaway escape system as described in claim 25 and further comprising a means for linking a plurality of modular systems in series.

27. A modular open areaway escape system as described in claim 26 wherein said means for linking comprises:

a. one central side wall member for each additional modular system linked in series to a first modular system said first system comprising two side wall members; and b. a means for connecting adjacent units to said central side wall member.

28. A modular open areaway escape system as described in claim 27 wherein said means for connecting adjacent units comprises dovetail connectors on said step facings.

29. A modular open areaway escape system as described in claim 25 and further comprising an upper flange along said top edge.

30. A modular open areaway escape system as described in claim 29 wherein said cover is attached to said upper flange.

31. A modular open areaway escape system as described in claim 17 wherein means for escaping comprises a plurality of steps and wherein said first and second side walls, the foundation, and each of said step facing define a space wherein a circle having a diameter not less than 30 inches may be inscribed on a horizontal plane within said space.

32. A modular open areaway escape system as described in claim 29 and further comprising at least one handle.

33. A modular open areaway escape system as described in claim 32 wherein said handle is a recess molded into said areaway.

34. A modular open areaway escape system as described in claim 15 and further comprising a means for efficiently storing said individual sections.

35. A modular open areaway escape system as described in claim 34 wherein similar individual sections nest together.

* * * * *